US012782087B2

(12) United States Patent
Zehnder et al.

(10) Patent No.: US 12,782,087 B2
(45) Date of Patent: Nov. 3, 2026

(54) TRIGGER GUARD SHEATH

(71) Applicants: Hannah Zehnder, Louisville, KY (US); Elijah Peel, Louisville, KY (US)

(72) Inventors: Hannah Zehnder, Louisville, KY (US); Elijah Peel, Louisville, KY (US)

( * ) Notice: Subject to any disclaimer, the term of this patent is extended or adjusted under 35 U.S.C. 154(b) by 228 days.

(21) Appl. No.: 18/605,214

(22) Filed: Mar. 14, 2024

(65) Prior Publication Data

US 2024/0318938 A1 Sep. 26, 2024

Related U.S. Application Data

(60) Provisional application No. 63/453,308, filed on Mar. 20, 2023.

(51) Int. Cl.
*F41C 33/04* (2006.01)
*F41C 33/02* (2006.01)

(52) U.S. Cl.
CPC ..... *F41C 33/04* (2013.01); *F41C 33/0209* (2013.01)

(58) Field of Classification Search
CPC ..... F41C 33/04; F41C 33/0209
See application file for complete search history.

(56) References Cited

U.S. PATENT DOCUMENTS 4,759,482 A * 7/1988 Olsen ..... F41C 33/0227 224/912
4,785,983 A * 11/1988 DeSantis ..... F41C 33/0227 224/604
4,925,075 A * 5/1990 Rogers ..... F41C 33/0245 224/244
5,810,222 A * 9/1998 Shoemaker ..... F41C 33/0263 224/244
6,085,951 A * 7/2000 Beletsky ..... F41C 33/0263 224/244
8,925,773 B2 * 1/2015 Clifton ..... F41C 33/0209 224/198
10,415,927 B1 * 9/2019 Shults ..... F41C 33/043
10,914,550 B1 * 2/2021 Dirlam ..... F41C 33/02
11,441,871 B1 * 9/2022 Weber ..... F41C 33/048
D1,056,463 S * 1/2025 Evans ..... D3/222
2005/0035163 A1 * 2/2005 French ..... F41C 33/045 224/912
2005/0205621 A1 * 9/2005 Shults ..... F41G 11/003 224/198
2005/0279788 A1 * 12/2005 Lowe ..... F41C 33/0254 224/244
2006/0226185 A1 * 10/2006 Har-Shen ..... F41C 33/0263 224/244

(Continued)

*Primary Examiner* — Brian D Nash
(74) *Attorney, Agent, or Firm* — Leason Ellis LLP

(57) ABSTRACT

A trigger guard sheath for a pistol and is configured to be disposed within a holster. The sheath includes an integral body that includes a top section having a first width and configured to receive a barrel or slide of the pistol and a bottom section having a second width and configured to receive a trigger and trigger guard of the pistol. The integral body includes a first protrusion that extends radially outward from a first end of the top section and a first protrusion that extends radially outward from a first end and an inner wall of the top section in a first direction and a second protrusion that extends radially outward from a second end and outer wall of the bottom section in a second direction that is opposite the first direction.

19 Claims, 7 Drawing Sheets

(56) References Cited

U.S. PATENT DOCUMENTS

Figure 1:
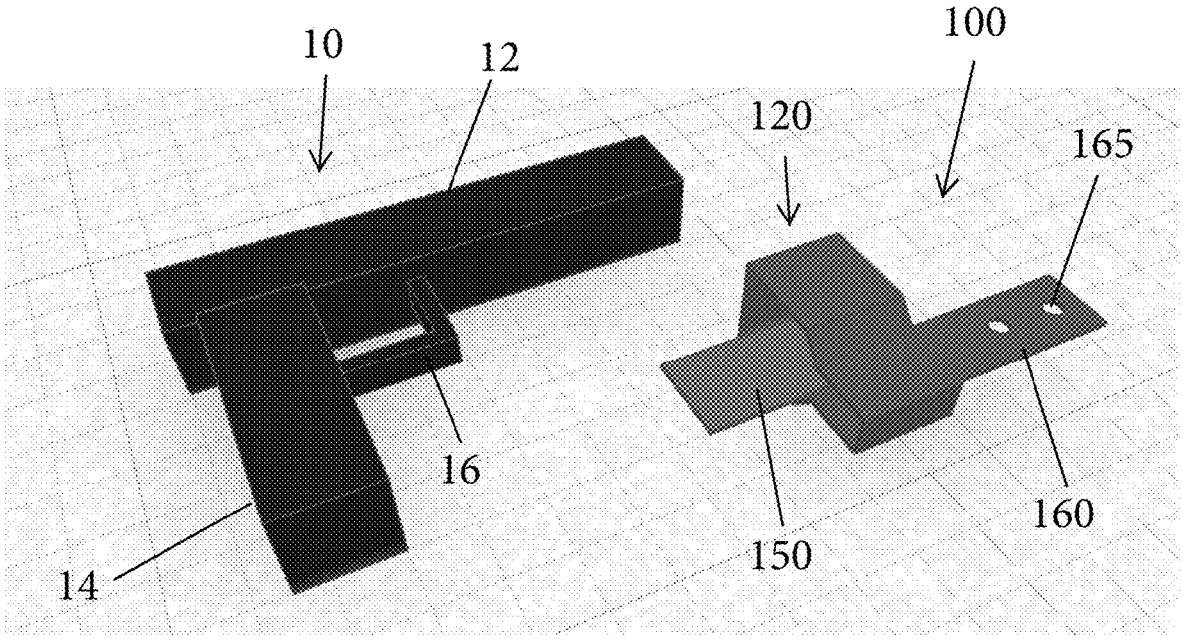
Figure 2:
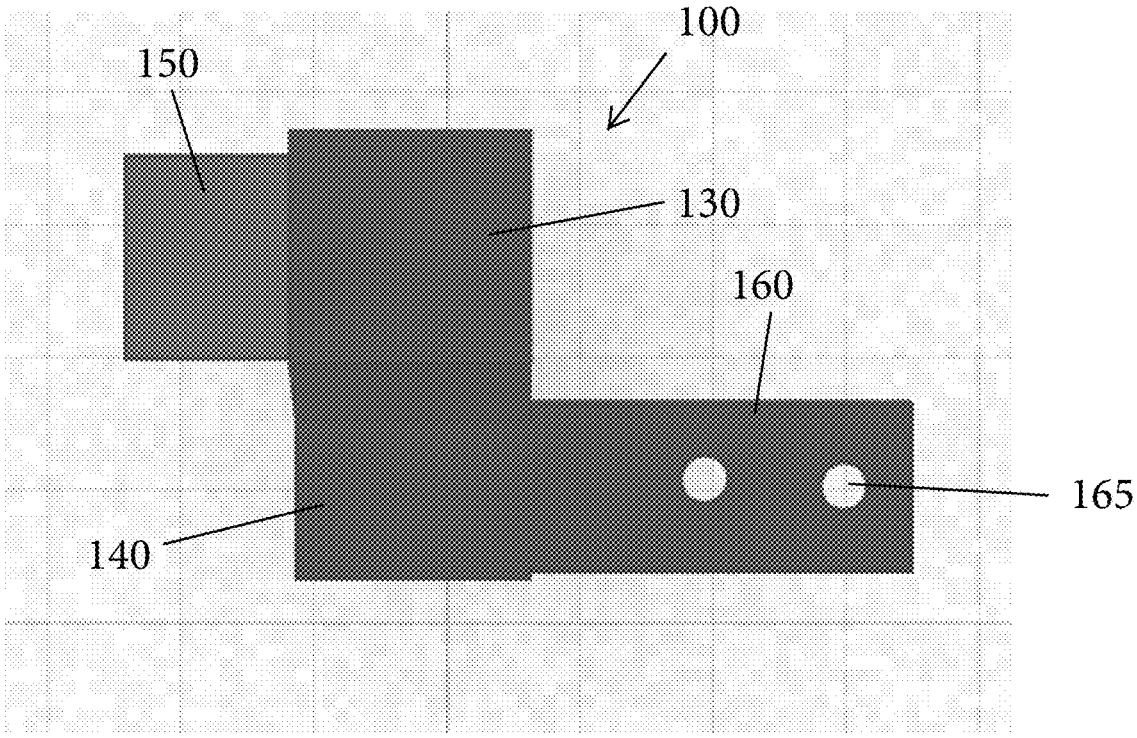
Figure 3:
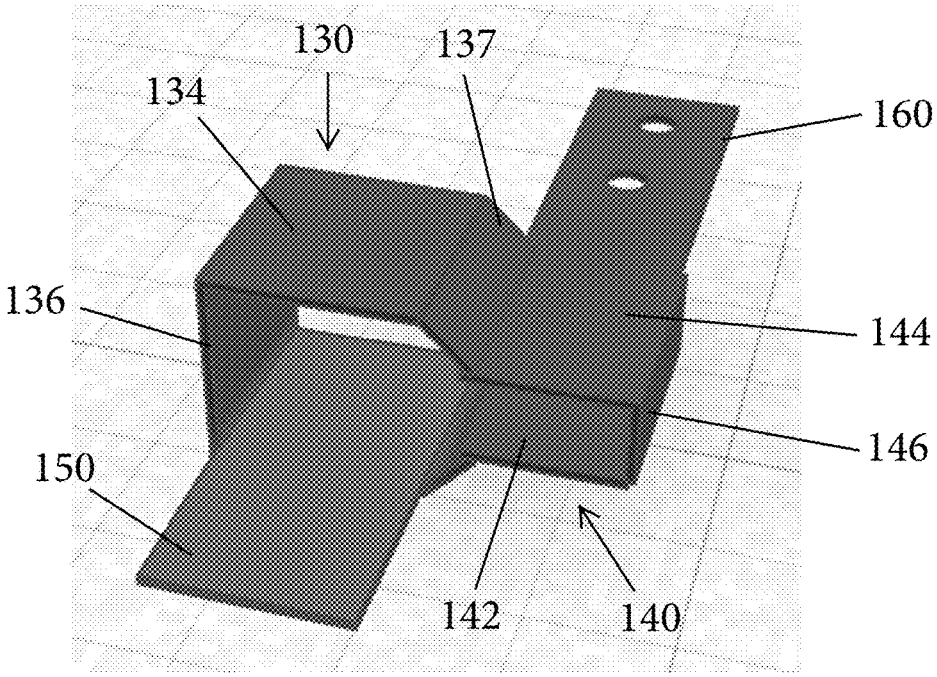
Figure 4:
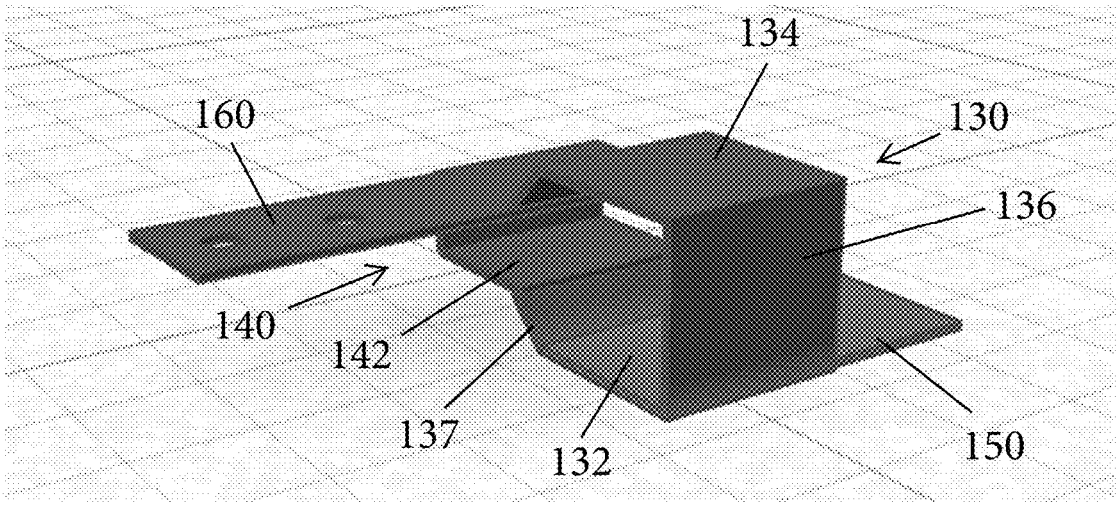
Figure 5:
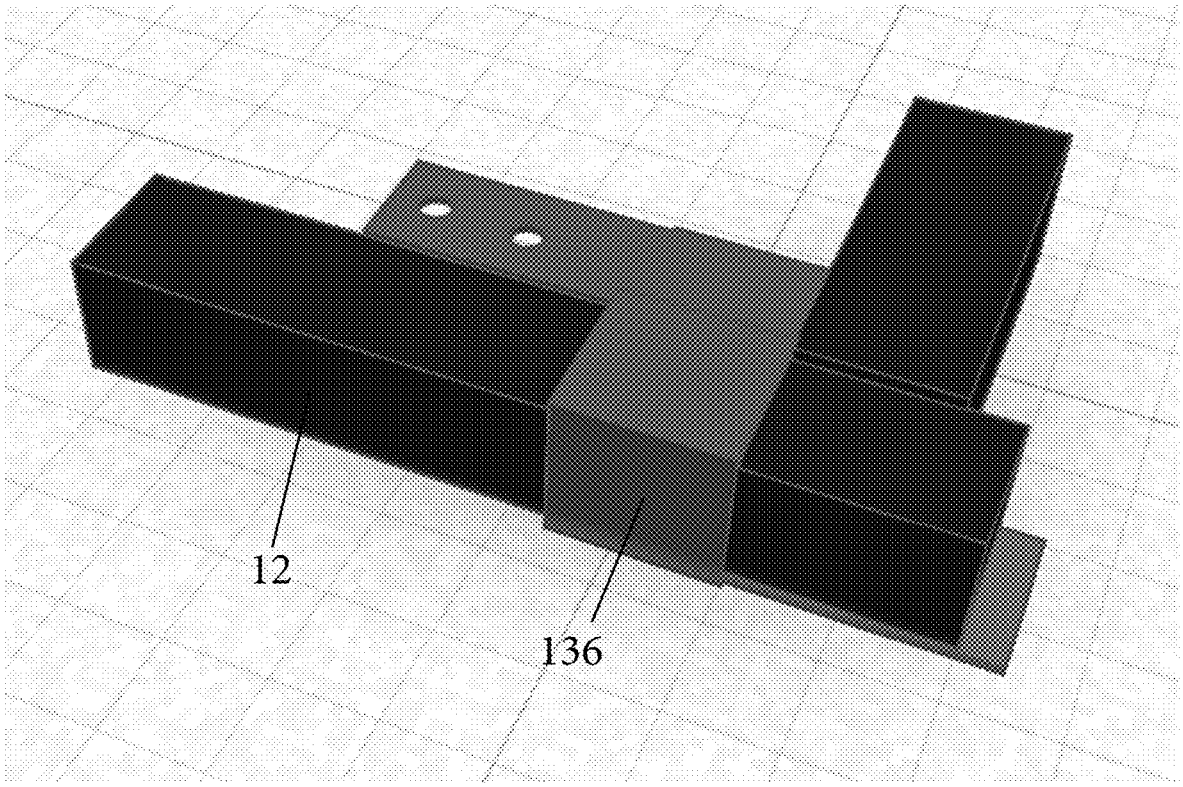
Figure 6:
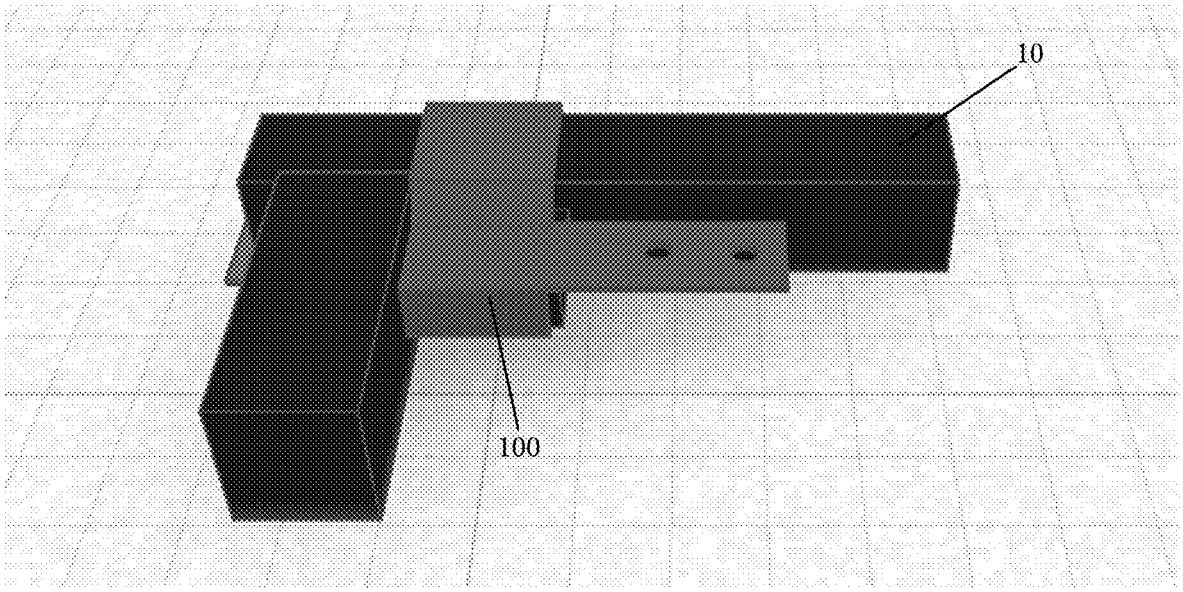
Figure 7:
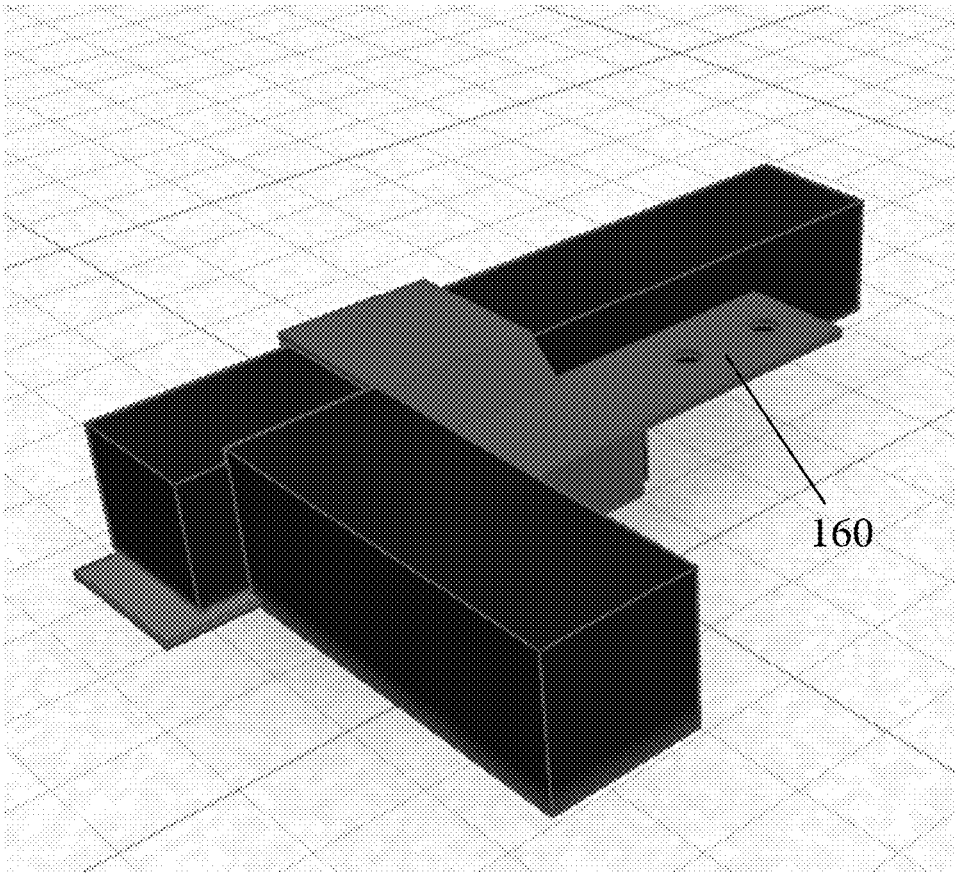
Figure 8:
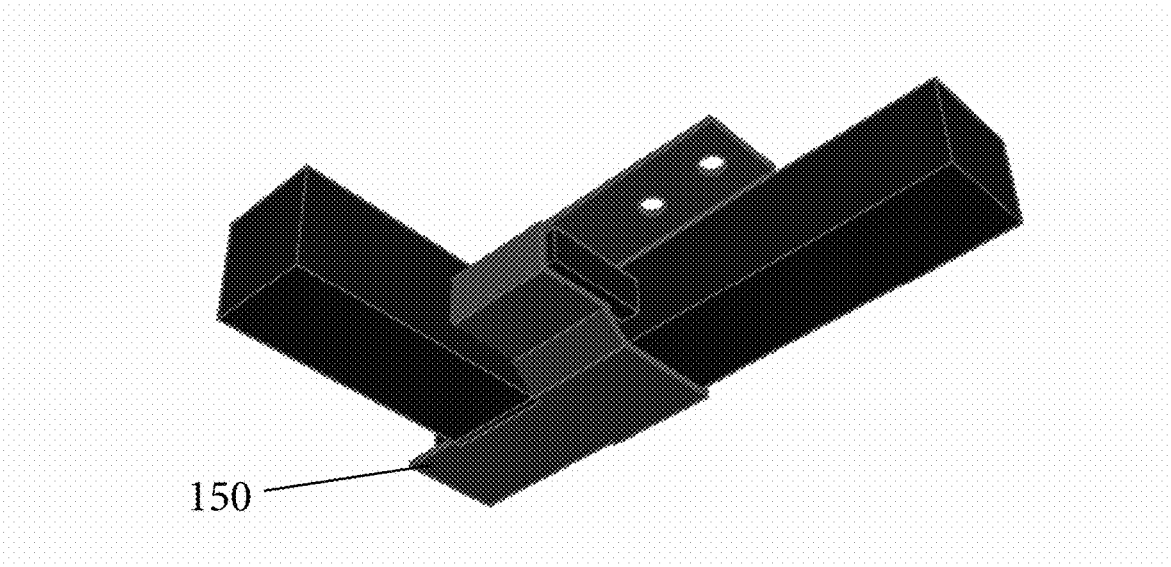
Figure 9:
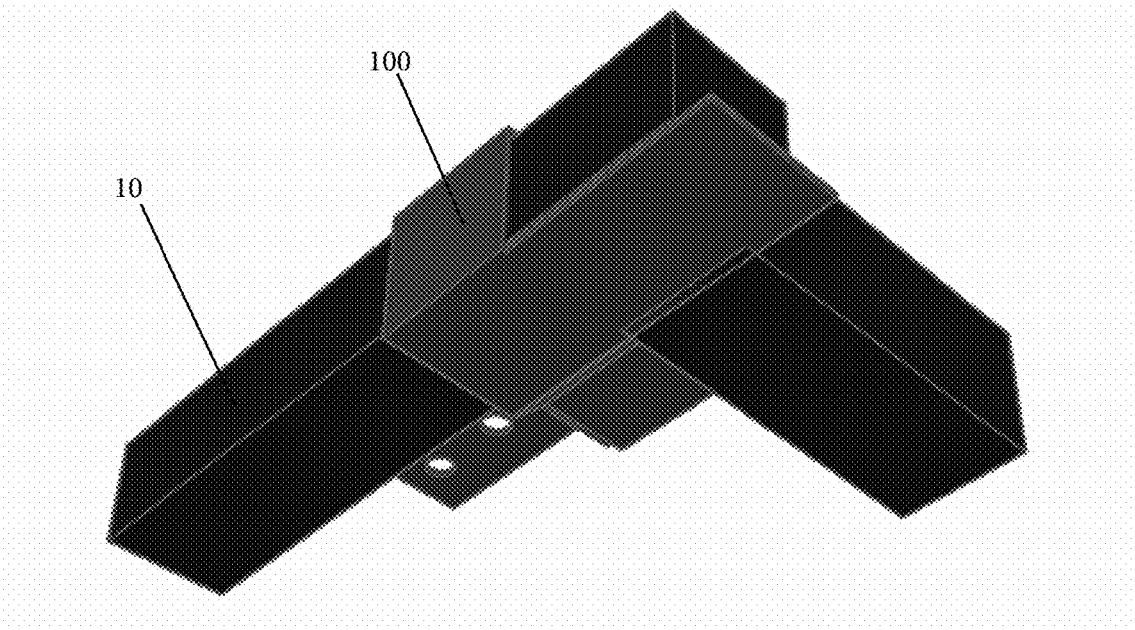
Figure 10:
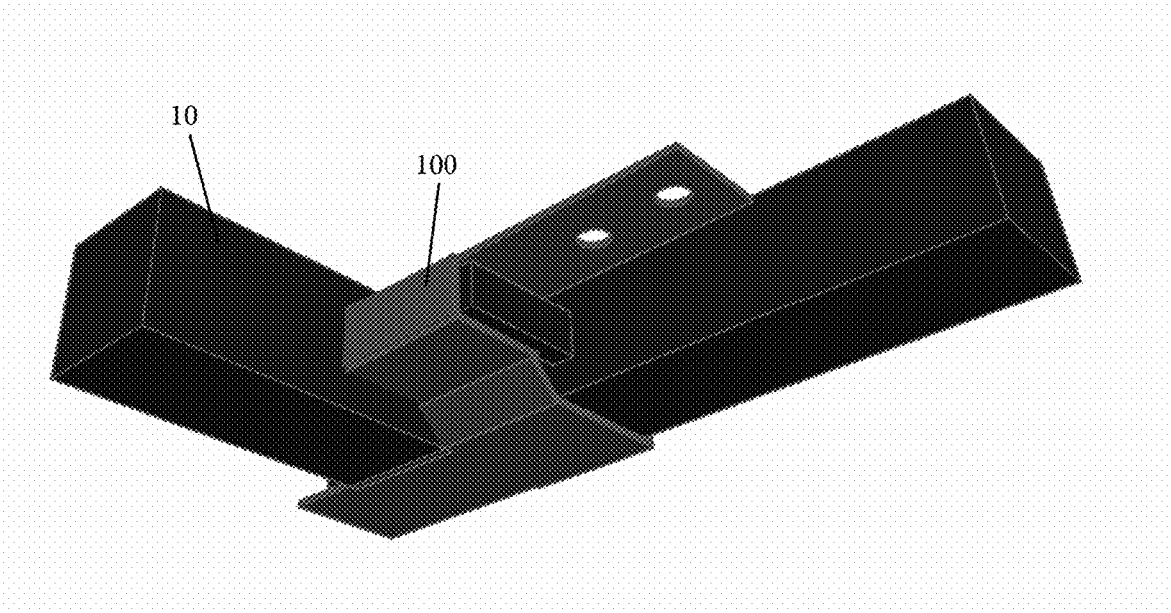

| | | | | |
|---|---|---|---|---|
| 2016/0091279 | A1* | 3/2016 | Massaro, Jr. | F41C 33/04 224/581 |
| 2016/0102940 | A1* | 4/2016 | Sykes | B32B 27/304 224/587 |
| 2017/0089666 | A1* | 3/2017 | Considine | F41C 33/048 |
| 2017/0284755 | A1* | 10/2017 | Farringer | F41C 33/0209 |
| 2017/0292809 | A1* | 10/2017 | Romano | F41H 5/0471 |
| 2018/0010885 | A1* | 1/2018 | Tedder | F41C 33/0209 |
| 2018/0135939 | A1* | 5/2018 | Tedder | F41C 33/02 |
| 2019/0128640 | A1* | 5/2019 | Shinkle | F41C 33/041 |
| 2019/0249950 | A1* | 8/2019 | Tedder | F41C 33/0263 |
| 2020/0408487 | A1* | 12/2020 | Foster | F41C 33/043 |
| 2021/0310766 | A1* | 10/2021 | Haygood | F41C 33/0227 |
| 2022/0155042 | A1* | 5/2022 | Considine | F41C 33/046 |
| 2022/0163288 | A1* | 5/2022 | Moultrie | F41C 33/0209 |
| 2024/0125578 | A1* | 4/2024 | McGrane | F41C 33/048 |
| 2024/0142199 | A1* | 5/2024 | Hauptman | F41C 33/0209 |
| 2024/0426571 | A1* | 12/2024 | Smith | F41C 33/0236 |

* cited by examiner

TRIGGER GUARD SHEATH

CROSS-REFERENCE TO RELATED PATENT APPLICATIONS

This application is based on and claims priority to U.S. Provisional Patent Application No. 63/453,308, filed Mar. 20, 2023, the entire contents of which is incorporated by reference herein as if expressly set forth in its respective entirety herein.

BACKGROUND

A firearm trigger is a mechanism that actuates the function of a ranged weapon, such as a firearm, airgun, crossbow or speargun, etc. As can be imagined, safety is paramount with firearm construction and one of the safety features is a trigger guard. A trigger guard is a protective loop surrounding the trigger of a firearm designed to prevent unwanted contact with the trigger, which may cause an accidental discharge.

SUMMARY

A trigger guard sheath for a pistol is configured to be disposed within a holster. The trigger guard sheath includes an integral body that includes a top section having a first width and configured to receive a barrel or slide of the pistol and a bottom section having a second width and configured to receive a trigger and trigger guard of the pistol. The integral body includes a first protrusion that extends radially outward from a first end of the top section and a first protrusion that extends radially outward from a first end and an inner wall of the top section in a first direction and a second protrusion that extends radially outward from a second end and outer wall of the bottom section in a second direction that is opposite the first direction.

BRIEF DESCRIPTION OF THE DRAWING FIGURES

Figure 11:
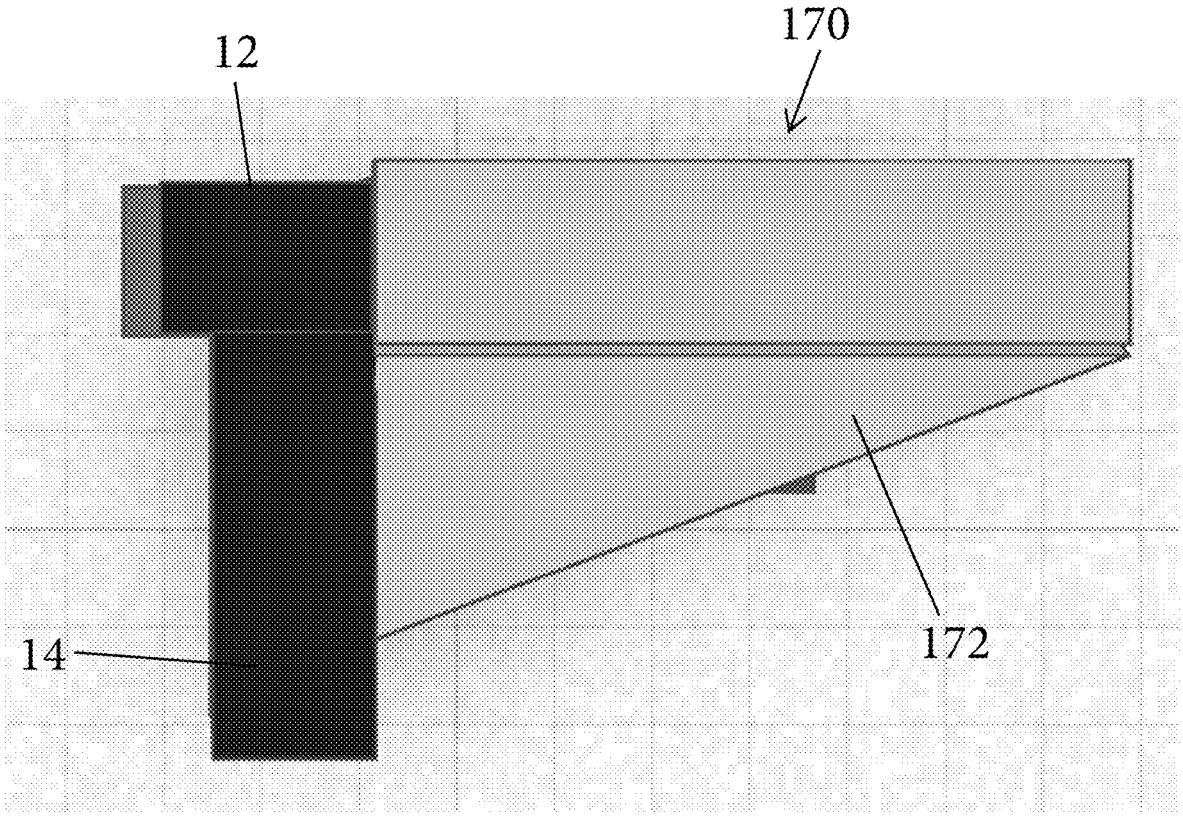
Figure 12:
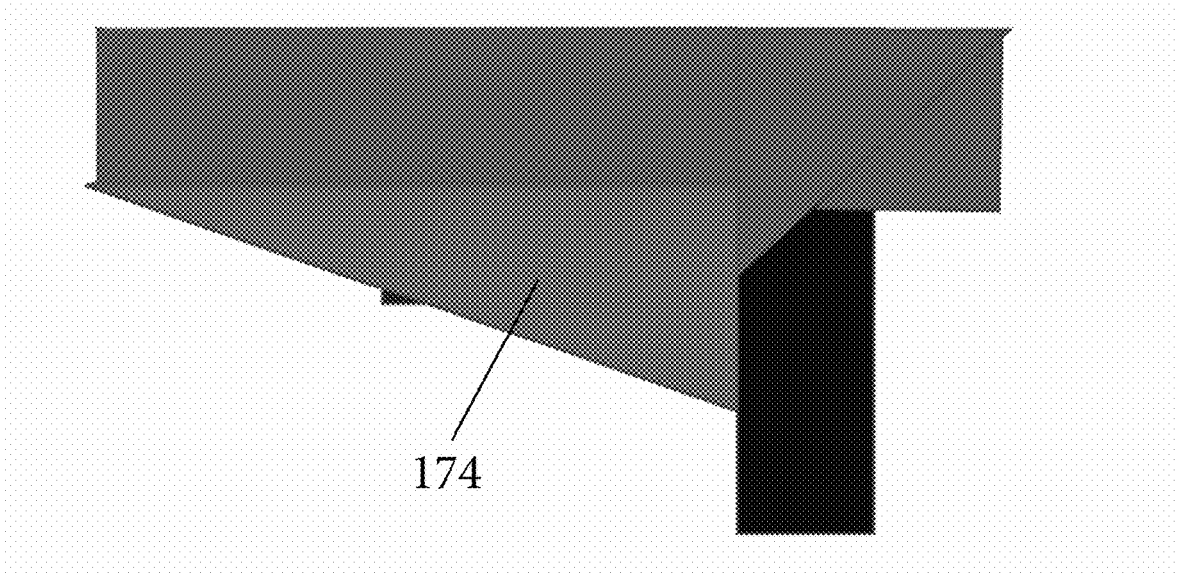
Figure 13:
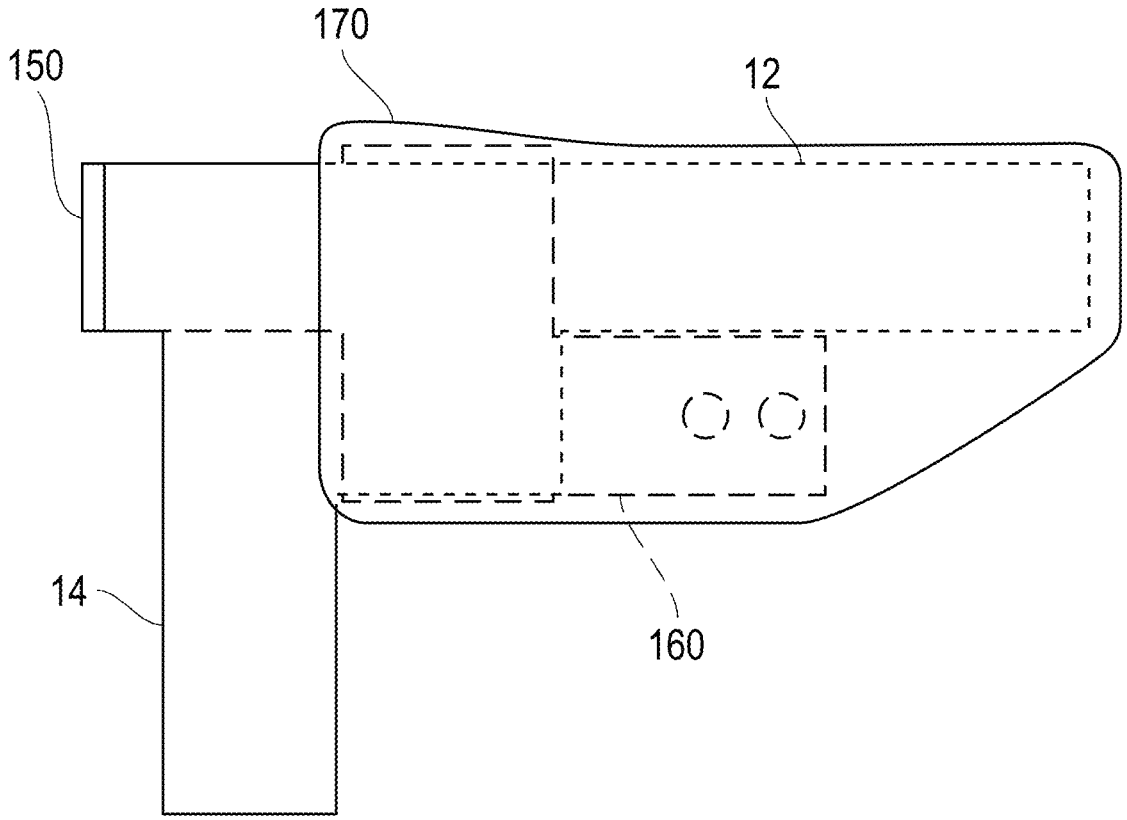

FIGS. 1-10 illustrate a trigger guard sheath according to one embodiment; and FIGS. 11-13 illustrate a holster incorporating the trigger guard sheath.

DETAILED DESCRIPTION OF CERTAIN EMBODIMENTS

As shown in the figures, a trigger guard sheath 100 is illustrated for use with a firearm, such as pistol 10. As is known, the pistol 10 includes common parts found in all or most pistols including a barrel or slide 12, a grip 14, a trigger (not shown), and a trigger guard 16.

The trigger guard sheath 100 is formed preferably as a single part (e.g., single piece of molded plastic) in the form of an inner shell. More particularly, the trigger guard sheath 100 is intended to form part of a holster (See, FIGS. 11-13).

The trigger guard sheath 100 is formed of a suitable rigid material, including but not limited to, suitable plastics. Foer example, in one embodiment, the trigger guard sheath 100 is formed of a KYDEX material. As is known, KYDEX is a line or thermoplastic acrylic-polyvinyl chloride materials manufactured by Sekisui SP. Other possible materials for the trigger guard sheath 100 include, but are not limited to, Boltaron, injection molded polymers or other thermoformed plastics.

The trigger guard sheath 100 can be a molded part that is constructed in view of the construction of the pistol 10. The trigger guard sheath 100 is constructed to envelope a portion of the pistol 10 as illustrated and described herein. The trigger guard sheath 100 has a main portion 120 that entirely encompasses and surrounds the pistol 10. As shown, the main portion 120 has a top section 130 and a bottom section 140. The top section 130 has greater dimensions than the bottom section 140 on the basis that the top section 130 is configured to receive and surround the barrel or slide 12 of the pistol 10, while the bottom section 140 is designed to surround the trigger and trigger guard 16.

As illustrated, the top section 130 can be defined by a first side wall 132, an opposing second side wall 134 and a top wall 136 that extends between the first and second side walls 132, 134 that are oriented parallel to one another. The sides of the top section 130 can also include a pair of inwardly tapered walls 137 located at the interface between the top section 130 and the bottom section 140.

This distance between the first side wall 132 and the second side wall 134 has a first value.

The bottom section 140 opens into the top section 130 and is defined by a first side wall 142, an opposing second side wall 144 and a bottom wall 146. The distance between the first side wall 142 and the second side wall 144 has a second value which is less than the first value. The top wall 136 and the bottom wall 146 are parallel to one another.

The trigger guard sheath 100 has a first protrusion 150 and a second protrusion 160. The first protrusion 150 is an extension of the first side wall 132 that protrudes laterally beyond the second side wall 134. The first protrusion 150 extends in a first direction. The second protrusion 160 is an extension of the second side wall 144 that protrudes laterally beyond the first side wall 142. The first and second protrusions 150, 160 thus extend in opposite directions. When the pistol 10 is inserted into the trigger guard sheath 100, the first direction is a direction toward the proximal end of the barrel or slide 12, while the second direction is a direction toward the distal end of the barrel or slide 12.

The lengths of the first and second protrusions 150, 160 can be different as shown or can be similar or the same. In the illustrated embodiment, the second protrusion 160 is longer than the first protrusion 150. As shown, the length of the first protrusion 150 is selected so that when the pistol 10 is inserted into the trigger guard sheath 100, the first protrusion 150 extends to or slightly beyond the proximal end of the barrel or slide 12.

The first protrusion 150 and the second protrusion 160 can each have a parallelogram shape, such as a square or rectangular shape.

The second protrusion 160 can have one or more holes 165 formed therein. As illustrated, there are two circular holes 165 that are spaced apart. The holes 165 can be used to couple the trigger guard sheath 100 to the holster 170.

The first and second protrusions 150, 160 are thus located in parallel planes that are spaced apart from one another. This distance between the two planes is sized so that the barrel or slide 12 is snugly fit therebetween when the barrel or slide 12 is inserted into the trigger guard sheath 100. The trigger guard sheath 100 is configured such that when the pistol 10 is inserted into the trigger guard sheath 100, the trigger portion of the pistol 10, including the trigger and the trigger guard 16, are received and contained within the top section 130 and bottom section 140. In this position, the second protrusion 160 extends in the distal direction from the trigger guard 16. In the illustrated embodiment, the second protrusion 160 does not extend to the distal end of the barrel or slide 12 but terminates prior thereto.

A holster 170 covers the trigger guard sheath 100. The holster 170 has a footprint that is bigger than the footprint of the trigger guard sheath 100 since the holster 170 covers the trigger guard sheath 100. The holster 170 has a first side 172 and an opposite second side 174 that define an open interior space in which the trigger guard sheath 100 is disposed and into which the pistol 10 is deposited. The holster 170 also wraps over the top of the barrel or slide 12 and has an open first end for receiving the pistol 10 and the opposite second end is at least partially closed (e.g., stitched closed or otherwise closed off).

The holster 170 can be formed of one or more layers. In particular, the holster 170 can be formed of a first layer and optionally a second layer. The first layer is a TPU (thermoplastic polyurethane) and the second layer can be a cloth layer (e.g., a synthetic cloth or a blend of synthetic cloths). For example, the first layer can be a TPU layer having a thickness between ⅛" and ½".

The coupling between the holster 170 and the trigger guard sheath 100 can be achieved using any number of traditional techniques including but not limited to using adhesive and bonding agents (e.g., high strength glue) or through a mechanical connection through the mounting with hardware, such as clips, or loops just on top of the holster 170.

Alternative materials to TPU for the first layer of the holster 170 include but are not limited to neoprene, or any other combination of Polyethene, Polyurethane, Ethylene Vinyl Acetate or Styrene Butadiene Rubber foams. The second layer 174 can be a material selected from the group consisting of: Elastane, Spandex, Nylon, Mesh, Jersey, Lycra, Tulle, viscose jacquard, or wool. Additionally, the second layer of the holster may have embedded materials such as Acrylic or Polymethyl Methacrylate (PMMA), Polycarbonate (PC), Polyethylene (PE), Polypropylene (PP), Polyethylene Terephthalate (PETE or PET), Polyvinyl Chloride (PVC), Acrylonitrile-Butadiene-Styrene (ABS).

The construction of the trigger guard sheath 100 in general is designed to thus full encompass from the bottom of the trigger guard 16 to the top of the firearm slide or barrel 12. This will form a sleeve of sorts as long as the trigger guard is front to back. It will also be appreciated that the first protrusion 150 is on the side of the firearm (pistol 10) carried toward the body. This first protrusion 150 is located toward the top of the sheath 100 and will be just long enough to maintain the rigidity of the TPU layer so as to not allow it to fold over either direction. The second protrusion 160 is on the side of the firearm (pistol 10) away from the body. This second protrusion 160 is located toward the bottom of the sheath 100 and will be just long enough to mount the selected holster hardware (i.e., clips, loops . . . etc.).

The holster 170 thus forms a pocket to house the parts of the pistol 10 that are not covered by the trigger guard sheath 100. The holster 170 also covers the trigger guard sheath 100. The holster 170 can include different indicia and can be formed in different colors.

Optionally, mounting hardware, such as a clip or loop can be used and is commercially available from a number of sources.

In one aspect of the present invention, the trigger guard sheath 100 is designed so that the pistol snuggle "clips" into the trigger guard sheath 100. Auditory feedback can be provided such as a clicking action.

Various embodiments of systems, devices, and methods have been described herein. These embodiments are given only by way of example and are not intended to limit the scope of the claimed inventions. It should be appreciated, moreover, that the various features of the embodiments that have been described may be combined in various ways to produce numerous additional embodiments. Moreover, while various materials, dimensions, shapes, configurations and locations, etc. have been described for use with disclosed embodiments, others besides those disclosed may be utilized without exceeding the scope of the claimed inventions.

Persons of ordinary skill in the relevant arts will recognize that the subject matter hereof may comprise fewer features than illustrated in any individual embodiment described above. The embodiments described herein are not meant to be an exhaustive presentation of the ways in which the various features of the subject matter hereof may be combined. Accordingly, the embodiments are not mutually exclusive combinations of features; rather, the various embodiments can comprise a combination of different individual features selected from different individual embodiments, as understood by persons of ordinary skill in the art. Moreover, elements described with respect to one embodiment can be implemented in other embodiments even when not described in such embodiments unless otherwise noted.

Although a dependent claim may refer in the claims to a specific combination with one or more other claims, other embodiments can also include a combination of the dependent claim with the subject matter of each other dependent claim or a combination of one or more features with other dependent or independent claims. Such combinations are proposed herein unless it is stated that a specific combination is not intended.

Any incorporation by reference of documents above is limited such that no subject matter is incorporated that is contrary to the explicit disclosure herein. Any incorporation by reference of documents above is further limited such that no claims included in the documents are incorporated by reference herein. Any incorporation by reference of documents above is yet further limited such that any definitions provided in the documents are not incorporated by reference herein unless expressly included herein.

For purposes of interpreting the claims, it is expressly intended that the provisions of 35 U.S.C. § 112(f) are not to be invoked unless the specific terms "means for" or "step for" are recited in a claim.

What is claimed is:

1. A trigger guard sheath for a pistol and configured to be disposed within a holster, the trigger guard sheath comprising:

an integral body that includes a top section having a first width and configured to receive a barrel or slide of the pistol and a bottom section having a second width and configured to receive a trigger and trigger guard of the pistol, wherein the top section is defined by a first side wall, an opposing second side wall, and a top wall extending between the first and second side walls, wherein the bottom section is defined by a first side wall, an opposing second side wall, and a bottom wall, the integral body including: (a) a first protrusion extending laterally outward from the first side wall of the top section in a first direction; and (b) a second protrusion extending laterally outward from the second side wall of the bottom section in a second direction opposite the first direction, wherein the first protrusion and the second protrusion are disposed in parallel planes spaced from one another to permit the barrel or slide of the pistol to be receivable therebetween when the pistol is inserted into the trigger guard sheath.

2. The trigger guard sheath of claim 1, wherein the first width is greater than the second width.

3. The trigger guard sheath of claim 1, wherein a length of the second protrusion is greater than a length of the first protrusion.

4. The trigger guard sheath of claim 1, wherein the integral body comprises a rigid part.

5. The trigger guard sheath of claim 1, wherein the integral body is formed of a thermoplastic acrylic-polyvinyl chloride material.

6. The trigger guard sheath of claim 1, wherein the first protrusion is configured to extend along an inner side of the barrel or slide of the pistol and the second protrusion is configured to extend along an outer side of the barrel or slide and distally beyond the trigger guard.

7. The trigger guard sheath of claim 1, wherein the holster defines an interior pocket in which the trigger guard sheath is disposed, the interior pocket being opened at a first end for receiving the pistol and permitting the pistol to engage the trigger guard sheath within the interior pocket.

8. The trigger guard sheath of claim 7, wherein the holster comprises a first layer comprising thermoplastic polyurethane (TPU) and a second layer comprising cloth.

9. The trigger guard sheath of claim 7, wherein the trigger guard sheath is exposed along an inner surface of the holster within the interior pocket thereof.

10. The trigger guard sheath of claim 7, wherein the trigger guard sheath is securely affixed to the holster.

11. The trigger guard sheath of claim 10, wherein the trigger guard sheath is securely affixed to the holster by an adhesive or bonding agent.

12. The trigger guard sheath of claim 10, wherein the trigger guard sheath is securely affixed to the holster by one or more fasteners.

13. The trigger guard sheath of claim 7, wherein the holster comprises a TPU layer covered with one or more cloth layers that define an exterior of the holster.

14. The trigger guard sheath of claim 1, wherein the integral body encloses the trigger and trigger guard while leaving a grip portion of the pistol exposed.

15. The trigger guard sheath of claim 1, wherein the trigger guard sheath defines an inner shell disposed within the holster and wherein the first protrusion is configured to stabilize the trigger guard sheath along a body-facing side of the pistol and the second protrusion is configured to provide a mounting interface with the holster.

16. The trigger guard sheath of claim 1, wherein the second protrusion includes one or more apertures configured to receive a fastener for securing the trigger guard sheath to the holster.

17. The trigger guard sheath of claim 1, wherein the first protrusion extends toward a proximal end of the barrel or slide and the second protrusion extends toward a distal end of the barrel or slide and wherein a distance between the first protrusion and the second protrusion corresponds to a thickness of the barrel or slide of the pistol.

18. A trigger guard sheath for a pistol and configured to be disposed within a holster, the trigger guard sheath comprising:

an integral body that includes a top section having a uniform first width and configured to receive a barrel or slide of the pistol and a bottom section having a uniform second width and configured to receive a trigger and trigger guard of the pistol, wherein the top section is defined by a first side wall, an opposing second side wall, and a top wall extending between the first and second side walls, wherein the bottom section is defined by a first side wall, an opposing second side wall, and a bottom wall, the integral body including: (a) a first protrusion extending laterally outward from the first side wall of the top section in a first direction; and (b) a second protrusion extending laterally outward from the second side wall of the bottom section in a second direction opposite the first direction, wherein the first protrusion and the second protrusion are disposed in parallel planes spaced from one another to permit the barrel or slide of the pistol to be receivable therebetween when the pistol is inserted into the trigger guard sheath;

wherein the first width is greater than the second width;

wherein a height of the first protrusion is equal to a height of each of the first side wall and the second side wall of the top section;

wherein a height of the second protrusion is equal to a height of each of the first side wall and the second side wall of the bottom section.

19. A combination comprising:

a pistol having a trigger end and an opposite barrel end; and a trigger guard sheath that receives the pistol and is configured to be disposed within a holster, wherein the trigger guard sheath comprises:

an integral body that includes a top section having a uniform first width and configured to receive a barrel or slide of the pistol and a bottom section having a uniform second width and configured to receive a trigger and trigger guard of the pistol, wherein the top section is defined by a first side wall, an opposing second side wall, and a top wall extending between the first and second side walls, wherein the bottom section is defined by a first side wall, an opposing second side wall, and a bottom wall, the integral body including: (a) a first protrusion extending laterally outward from the first side wall of the top section in a first direction; and (b) a second protrusion extending laterally outward from the second side wall of the bottom section in a second direction opposite the first direction, wherein the first protrusion and the second protrusion are disposed in parallel planes spaced from one another and the barrel or slide of the pistol is received therebetween when the pistol is inserted into the trigger guard sheath, the trigger end of the first protrusion covering the trigger end of the pistol;

wherein the second protrusion is parallel to the barrel or slide and has a length less than a length of the barrel or slide.

* * * * *